US005829612A

United States Patent [19]

Zumbuhl

[11] Patent Number: 5,829,612

[45] Date of Patent: Nov. 3, 1998

[54] TAB CONSTRUCTION FOR CLOSURES HAVING TAMPER EVIDENT RINGS

[76] Inventor: Bruno Zumbuhl, 1801 N. Kentucky Ave., Evansville, Ind. 47711

[21] Appl. No.: 8,998

[22] Filed: Jan. 20, 1998

Related U.S. Application Data

[60] Provisional application No. 60/043,687, Apr. 14, 1997.

[51] Int. Cl.[6] ..... B65D 41/34

[52] U.S. Cl. ..... 215/252; 215/44

[58] Field of Search ..... 215/44, 252

[56] References Cited

U.S. PATENT DOCUMENTS

| | | | |
|---|---|---|---|
| 4,402,418 | 9/1983 | Ostrowsky | 215/252 |
| 4,949,861 | 8/1990 | Cochran | 215/44 X |
| 5,107,998 | 4/1992 | Zumbuhl | 215/252 |
| 5,524,782 | 6/1996 | Salemi | 215/246 |
| 5,611,446 | 3/1997 | Ingram et al. | 215/252 |
| 5,755,347 | 5/1998 | Ingram | 215/252 |

*Primary Examiner*—Stephen K. Cronin
*Attorney, Agent, or Firm*—Charles E. Temko

[57] ABSTRACT

A threaded type tamper-indicating closure in which the tamper-indicating ring is separated from the cap element of the closure as the closure is opened, in which the tabs which contact an undersurface of a bead on the outer surface of an engaged container finish are prevented from flexing radially inwardly beyond a limited degree so as to assure that the tabs will function immediately as the closure commences unthreading. In the disclosed embodiment, this is accomplished by positioning the pivot axis of the tabs in substantially a common vertical plane therewith, so that the tabs pivot only slightly radially outwardly as they come into contact with the bead. The tamper-indicating ring includes an upper wall member of relatively reduced thickness to enable both bending and flexing radially outwardly during installation to enable the relatively rigid tabs to clear a radially outwardly extending bead on the container neck or finish. The tabs extend radially inwardly from an upper edge of a relatively thicker lower wall member of the tamper-indicating ring, and do not substantially bend or flex relative to the lower wall member during either installation or removal.

5 Claims, 2 Drawing Sheets

TAB CONSTRUCTION FOR CLOSURES HAVING TAMPER EVIDENT RINGS

RELATED APPLICATION

Reference is made to my copending applications, Ser. No. 08/490,533 filed Jun. 14, 1995, and Ser. No. 60/043,687, filed Apr. 14, 1997, which disclose and claim a related invention.

BACKGROUND OF THE INVENTION

This invention relates generally to the field of threaded closures for containers, and more particularly to synthetic resinous closures of relatively small diameter employed to seal containers of pressurized contents, typically, soft drinks, beer and other carbonated comestibles. Traditionally, such containers have been sealed using metallic caps commonly referred to as crown closures requiring the use of a tool for removal. Over the past fifteen to twenty years, such closures have been almost completely replaced by a synthetic resinous threaded closure, either injection molded, or more commonly, compression molded. Such closures are usually provided with a tamper-evident ring which depends from the lower edge of the cylindrical side wall of the closure, and is interconnected to said edge by frangible bridges formed during the molding operation, or by a separate slitting operation. Annual production of said closures surpasses that of most other types of closures, and not surprisingly, the art relating to such closures is in a highly developed state.

Although synthetic resinous closures of this type have many advantages, including the ability to be removed without the use of a tool, and the ability to reseal the container where all of the contents are not consumed upon first opening, they do present significant problems during manufacture and operation.

A serious problem lies in the provision of frangible ribs or bridges which interconnect the lower edge of the side wall or skirt of the closure with the tamper-indicating band or ring. The bridges must be sufficiently strong so as to avoid breaking when the closures are installed, either by threading or pressing the closures into position, and yet be capable of readily fracturing when the closure is unthreaded. To this end, designs have included the provision of some bridge members which are stronger than other bridge members, and are positioned in specific locations, this construction being partially successful where the tamper-evident ring is split and remains attached to the skirt of the closure during the removal of the same. Other constructions provide for a camming action utilizing inclined surfaces at the lower edge of the skirt and the lower edge of the tamper-indicating ring.

The most common construction used for fracturing the bridges when the closure is removed involves the use of flexible wings or tabs. One form uses tabs which engage the outer surface of the finish of the container to prevent rotation of the ring relative to the skirt. More commonly, the tabs are pivoted about an axis normal to the axis of the closure and have free ends which engage beneath a radially projecting bead on the outer surface of the container finish. The tabs are not only pivoted relative to the inner surface of the ring, but are flexible as well to permit easy removal without damage from a forming mold. The relatively thin cross section required to produce this flexibility has an adverse result in that the tabs are occasionally not sufficiently rigid to assure prompt breakage of the bridges when the closure is unthreaded. This problem is accommodated by the provision of a radially inwardly extending band on the inner surface of the ring against which the tabs are engaged after being progressively folded or flexed through approximately 135 degrees. This engagement reduces the effective diameter of the bead on the tamper-indicating ring to less than that of the corresponding bead on the outer surface of the container, so that it cannot pass the bead on the container, and continued unthreading of the closure serves to break the bridges. The use of this construction is almost mandatory where the bridges are of unequal strength. However, this construction in its so-called "second mode" of operation requires a substantial degree of unthreading of the closure before the bridges are broken, and no substantial leverage is obtained during such operation.

BRIEF DESCRIPTION OF THE PRIOR ART

In the above-mentioned copending applications, there is disclosed a tab construction in which the tabs are of sufficiently thick cross section to preclude the possibility of flexing as described to provide a purely pivotal movement about an axis perpendicular to the principal axis of the closure formed by an area of relatively thin cross section where the tabs are pivotally interconnected to the inner surface of the tamper-indicating ring. The tabs, in relatively unstressed condition extend radially inwardly at approximately a 30 degree angle with respect to the principal axis of the closure, and are generally polygonal in cross section. When the closure is unthreaded upon contact with a lower surface on the corresponding ring on the container neck, they will pivot to an additional 19–20 degrees, thus providing additional leverage to break the tamper ring bridges as the closure is progressively unthreaded. Thus, the tabs operate in only a single mode in which they are in relatively upright position.

While not without substantial utility, I have determined that when closures are made in accordance with this construction, the use of synthetic resinous materials lacking sufficient tensile strength sometimes permits excessive enlargement of the tamper-indicating rings to a degree which may permit the tabs to be pivoted through a horizontal plane and thus operate in the relatively undesirable so-called second mode, in which severing of the frangible bridges is accomplished by making the effective inner diameter of the tamper ring less than that of the diameter of the ring on the container finish. In this mode, substantially no leverage is obtained, and a much greater degree of unthreading must occur before the bridges are broken.

SUMMARY OF THE INVENTION

Briefly stated, the present invention contemplates the provision of an improved tab construction in which the possibility of the tabs pivoting inwardly to a degree wherein the tabs function in the so-called second mode of operation is completely eliminated. This is accomplished by locating the pivotal axis of the tabs radially inwardly as far as possible of the surfaces of the tab which contact a lower surface of the bead on the container finish, so that as the closure is unthreaded, forces transmitted from the bead on the finish to the tabs have substantially axially directed components. At the conclusion of only slight pivotal movement, at which time a planar surface of the tab comes into contact with a planar or frusto-conical surface on the bead on the container, the axially oriented components of the force are transmitted directly to the tamper-indicating ring and serve to break the interconnecting bridges in well-known manner. It is also desirable that when the closure is installed, the relatively thinner upper section of the tamper indicating ring be expanded radially to a substantially uniform degree over the entire periphery thereof. This expansion assures minimal possible breakage of the frangible bridges caused by canting of the closure before it is fully engaged. This is accomplished by the provision of a relatively thick set of tabs having a cross section bounded by four rectilinear sides to present line contact at an upper inner corner which engages the undersurface of the container neck bead as the tab substantially fills a right angle annular recess formed by an inner surface of the upper portion of the tamper-indicating ring, and an upper surface of a bead on the tamper indicating ring positioned immediately therebeneath. This last mentioned bead is discontinuous, and thus provides uniform expansion of the ring as the bead on the tamper ring passes over the bead on the container neck.

BRIEF DESCRIPTION OF THE DRAWINGS

In the drawings, to which reference will be made in the specification, similar reference characters have been employed to generate corresponding parts throughout the several views.

DETAILED DESCRIPTION OF THE DISCLOSED EMBODIMENT

Figure 1:
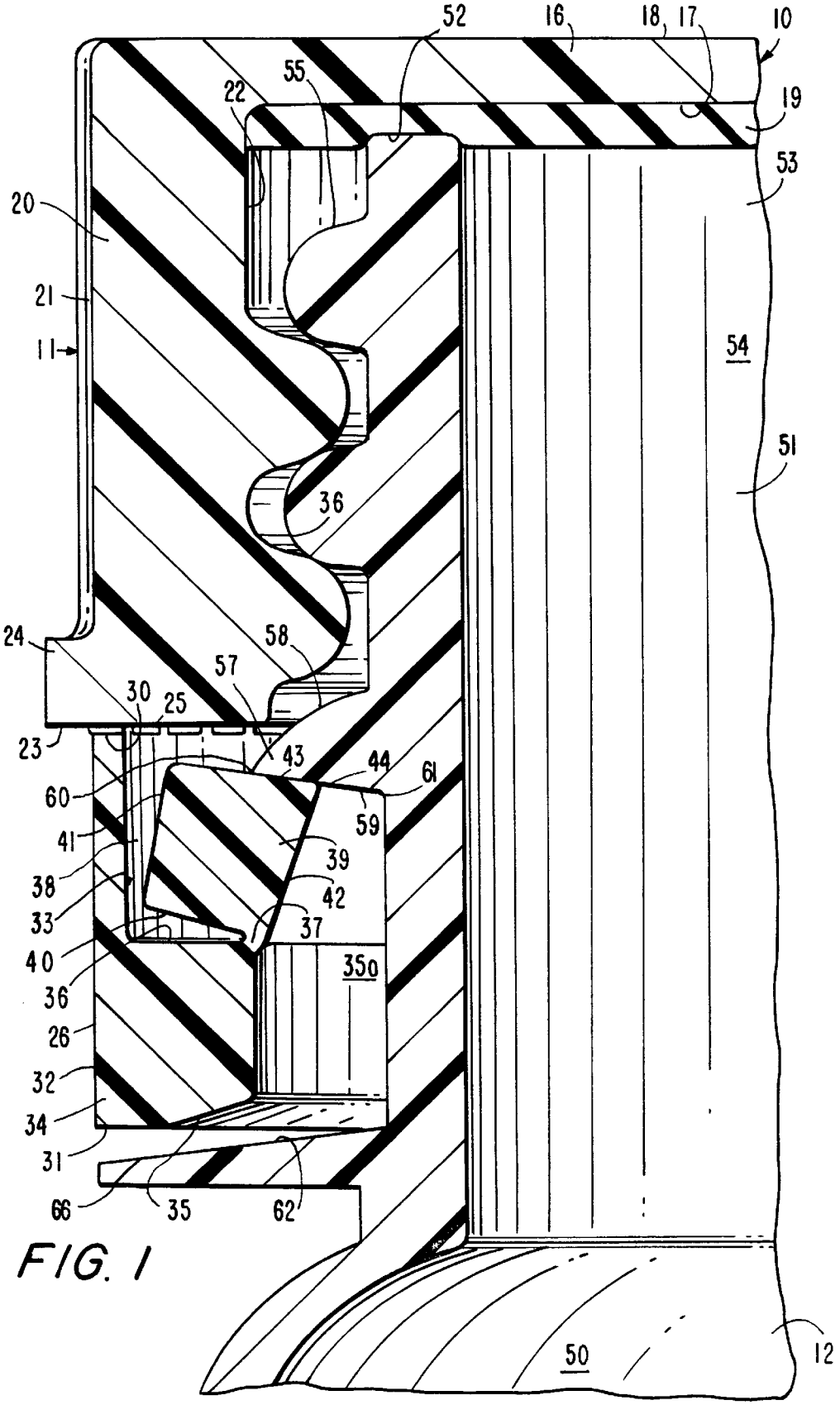
FIG. 1 is a fragmentary schematic sectional view of an embodiment of the invention.

In accordance with the disclosed embodiment of the invention, the device, generally indicated by reference character 10, comprises broadly: a closure element 11 and a container element 12.

The closure element 11 is of generally conventional configuration, and is preferably formed by compression molding using techniques well-known in the art. It includes an end wall 16, bounded by inner and outer surfaces 17 and 18, respectively, the inner surface supporting an optional resilient sealing gasket 19. Surrounding the end wall is a cylindrical side wall 20 bounded by an outer surface 21, a threaded inner surface 22, and a lower surface 23 having a depending flange 24 forming a frangible area 25 which interconnects with a separable tamper-indicating ring 26 which remains on the container finish when the body of the closure is unthreaded.

The tamper-indicating ring 26 includes an upper surface 30, a lower surface 31, an outer surface 32, and an inner surface 33 from which extends a radially inwardly projecting bead 34. The bead is bounded by a lower surface 35, an inner surface 35*a,* and an upper radially extending surface 36, the surfaces 36 and 35*a* meeting in an area of flexible thin cross section 37. The inner surface 33 and surface 36 form an annular recess 38 for reception of a plurality of tabs 39 which are slightly outwardly deflected as the closure element 11 is engaged with the container element 12.

The tabs 39 are thick in cross section and relatively inflexible, and are capable only of pivotal movement relative to the ring 26 about an axis through the area of thin cross section 37. In the disclosed embodiment, the tabs are of quasi-rectangular cross section to include a free end surface 40, outer and inner side surfaces 41 and 42, as well as a second end surface 43 which communicates with the surface 42 at a rounded edge 44.

The container element 12 is generally conventional, and may be formed as a preform from PET or synthetic resinous materials with comparable properties, as well as glass. It includes a hollow main body 50 from which a cylindrical neck or finish 51 extends. The finish 51 includes an annular end surface 52 bordering an open mouth 53 from which an inner surface 54 extends. A threaded outer surface 55 cooperates with the inner surface of the closure element. Beneath the lowermost convolution 36 thereof is an annular bead 57 which serves to engage the tabs 39 in known manner. The bead includes a rounded upper surface 58 and a frusto-conical lower surface 59. Optionally, the lower surface may lie in a radially extending plane (not illustrated). The surface 59 is bordered by an outer edge 60 and an inner edge 61.

The tabs 39, in relatively stressed condition occupy an annular recess 62 formed between a transfer ring 66 of the container element and the bead 57.

OPERATION

Figure 2:
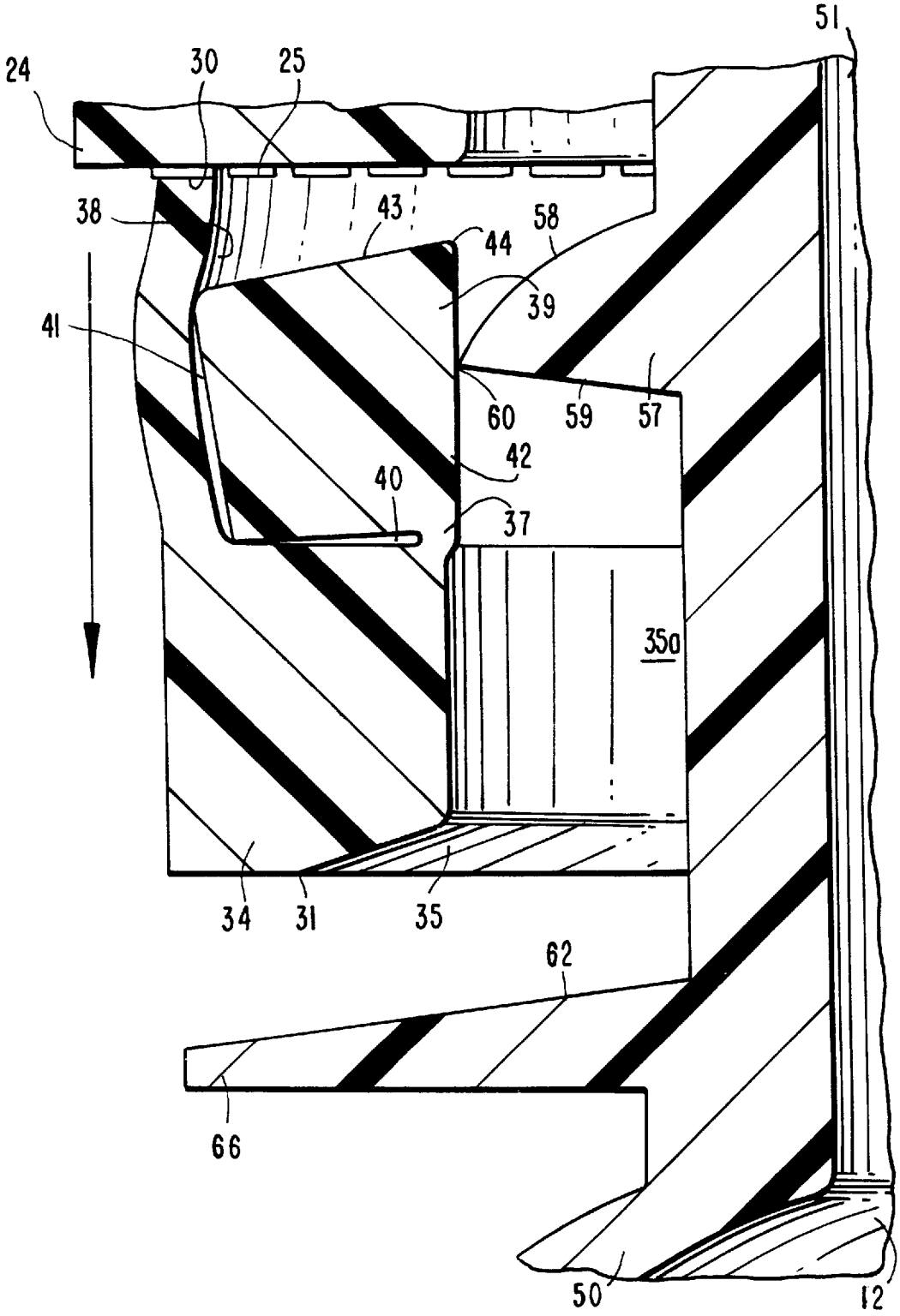
FIG. 2 is a fragmentary schematic sectional view of the embodiment during installation of the closure element, with certain of the component parts in altered relative position.

As seen in FIG. 2, the closure is initially engaged upon the container finish by threading or an axially oriented force. During installation, the tabs 39 will be pivoted radially outwardly into the recess 38 as they contact the upper surface 58 until the edge 44 clears the annular edge 60. This action is assisted by a radially outward expansion (not shown) of the tamper ring which is of relatively thin cross section above the bead 34, caused by contact of the outer side surfaces 41 of the tabs. Once clear, the tabs will assume a relatively less stressed condition shown in FIG. 1, in which they project into the space 65 between the bead 57 and the upper wall portion 66 of the container body.

When the closure is unthreaded to open the container, the tabs will remain substantially in the same position, pivoting slightly inwardly by contact of the edge 44 with the surface 59). This movement continues until the surface 59 of the bead 57 comes into planar contact with the surface 43, at which point, the camming action ceases. With further unthreading of the closure, the axial force developed between these surfaces is transmitted directly to the body of the tamper-indicating ring wherein the axially aligned components of the force effect breakage of the frangible area 25 almost immediately, thus severing the tamper ring which then remains on the container finish. The pivoting of the tabs during this action is in the order of approximately 30 degrees.

It is to be noted that since the area of thin cross section about which the tabs pivot is disposed only slightly radially inwardly of the edge 44 at all times, the tab is incapable of pivoting radially sufficiently inwardly to operate in the so-called "second mode", thus assuring a rapid breaking of the frangible area interconnecting the tamper-indicating ring to the body of the closure.

It is to be noted that to facilitate slight radial expansion of the tamper-indicating ring 26, the thickness of the upper portion of same is substantially reduced and the thickness of the bead 34 which is discontinuous over the periphery of the ring, is increased to form a quasi-rectangular cross section. The recess 38 is thus substantially larger in cross section, enabling the tabs 39 which are accommodated in the recess, to be substantially thicker.

The area of thin cross section about which the tabs pivot is positioned radially inwardly as far as possible, consistent with the need to enable the same to clear the bead on the container finish when the closure is installed. This location thus assures that in using the embodiment in conjunction with properly sized container finishes, when the closure is removed, the tabs will pivot only to a minimal degree, normally radially inwardly. This will assure rapid fracture of the frangible bridges which interconnect the tamper-indicating ring to the body of the closure. When the closure is used in conjunction with container finishes which are substantially undersized (although usually within commercial tolerances), the tabs will tend to pivot radially further inwardly, but such inward pivotal motion will be limited by the contact of the free end of the tab with the cylindrical surface of the container finish.

I wish it to be understood that I do not consider the invention to be limited to the precise details of structure shown and set forth in the specification, for obvious modifications will occur to those skilled in the art to which the invention pertains.

I claim:

1. In a combination container and threaded closure therefor, said closure having a tamper-indicating ring having an area frangibly interconnected to an annular edge surface of the body of said closure, said tamper-indicating ring having an inner surface and a plurality of radially inwardly extending tabs pivotally interconnected to said inner surface, said container having a cylindrical finish having a threaded outer surface and an annular tab engaging bead thereon, whereby the unthreading of said closure from said finish serves to disconnect said tamper-indicating ring from the body of said closure, the improvement comprising: said bead on said finish having a lower surface disposed at an angle with respect to the principal axis of said finish, said surface extending radially outwardly to an arcuate edge; said tamper-evident ring having an inner arcuate surface and a radially inwardly directed bead of relatively thick cross section, said bead having an upper radially oriented surface and an inner angularly oriented surface, said upper and inner surfaces meeting at an edge; said tabs being of relatively thick cross section, and being pivotally interconnected to said ring at an area of thin cross section adjacent said edge for radially inward and outward movement about an axis through said area of thin cross section, said tabs having a quasi-rectangular cross section, including an outer side surface, an upper surface, and an inner side surface positioned at an acute angle relative to said outer side surface, and having an edge bordering said upper and inner side surfaces; said edge being positioned, when said tabs are in relatively unstressed condition adjacent a lower surface of said bead on said container finish to selectively engage said upper surface of said tab in cammed relation upon the unthreading of said closure from said finish, to result in radially inward movement of said tabs to a point where said outer planar surface of said tabs are in contact with said inner surface of said tamper-indicating ring; further unthreading of said closure resulting in transmission of an axially directed component of force to said tamper-indicating ring to break the frangible interconnection between said tamper-indicating ring and said annular edge surface of said body of said closure.

2. The improvement in accordance with claim 1, in which when said tabs are in relatively unstressed condition, said edge is positioned radially inwardly of said area of thin cross section.

3. The improvement in accordance with claim 1, in which said surface of said bead on said container lies in a conical angle of approximately 120 degrees relative to a principal axis of said closure.

4. The improvement in accordance with claim 1, in which said tabs pivot inwardly during opening of said closure through an arc of about 30 degrees.

5. The improvement in accordance with claim 1, in which said outer side surface of said tabs contacts an inner surface of said tamper ring during installation.

* * * * *